US005826679A

United States Patent [19]

Chern

[11] Patent Number: 5,826,679

[45] Date of Patent: Oct. 27, 1998

[54] EMERGENCY ESCAPE DEVICE FOR BUILDINGS

[76] Inventor: Muh-Tsuen Chern, 22-17, Tay Kang, Tay Kang Village, Leou Ying Shiang, Tainan Hsien, Taiwan

[21] Appl. No.: 946,246

[22] Filed: Oct. 7, 1997

[51] Int. Cl.[6] ..... A62B 1/02

[52] U.S. Cl. ..... 182/238; 182/233; 182/71; 182/72

[58] Field of Search ..... 182/238, 233, 182/73, 236, 240, 71, 72

[56] References Cited

U.S. PATENT DOCUMENTS

| | | |
|---|---|---|
| 437,091 | 9/1890 | Carr . |
| 650,403 | 5/1900 | Larsson . |
| 696,931 | 4/1902 | Boettcher . |
| 936,385 | 10/1909 | Thornburg . |
| 4,616,735 | 10/1986 | Orgeron . |

FOREIGN PATENT DOCUMENTS

| | | | |
|---|---|---|---|
| 321688 | 6/1902 | France | 182/236 |

*Primary Examiner*—Alvin C. Chin-Shue
*Attorney, Agent, or Firm*—Larson & Taylor

[57] ABSTRACT

An emergency escape device for buildings in accordance with the present invention comprises a rotatably supported axle, a reel mounted on the shaft to rotate therewith, a string wound around the axle and having a first end securely attached to the axle and a second end, a weight means securely attached to the second end of the string, a cable wound around the reel and having a free end, the cable having a winding direction opposite to that of the string, a basket securely attached to the free end of the cable and having a weight smaller than that of the weight means, a hydraulic pump including a fluid path and an output shaft, a control valve mounted to the fluid path for controlling opening and closing of the fluid path to thereby control rotational movement of the output shaft, a transmission member for transmitting rotational movement of the output shaft to the axle, a rod mounted to the control valve for actuating the control valve, and a pull string having an end attached to the rod and a second end located adjacent to the basket for manually actuating the rod.

5 Claims, 6 Drawing Sheets

EMERGENCY ESCAPE DEVICE FOR BUILDINGS

BACKGROUND OF THE INVENTION

The present invention relates to an emergency escape device for buildings.

High-rise buildings are a trend in this world as the population increases dramatically. Emergency escape devices for the buildings have been proposed, and the structures thereof are often complicated. In addition, repetitious use of most of the emergency escape device is laborious. The present invention is intended to provide an improved emergency escape device which mitigates and/or obviates the above problems.

SUMMARY OF THE INVENTION

It is an object of the present invention to provide an emergency escape device which can be repetitiously used in a labor-saving way.

An emergency escape device for buildings in accordance with the present invention comprises a rotatably supported axle, a reel mounted on the shaft to rotate therewith, a string wound around the axle and having a first end securely attached to the axle and a second end, a weight means securely attached to the second end of the string, a cable wound around the reel and having a free end, the cable having a winding direction opposite to that of the string, a basket securely attached to the free end of the cable and having a weight smaller than that of the weight means, a hydraulic pump including a fluid path and an output shaft, a control valve mounted to the fluid path for controlling opening and closing of the fluid path to thereby control rotational movement of the output shaft, a transmission member for transmitting rotational movement of the output shaft to the axle, a rod mounted to the control valve for actuating the control valve, and a pull string having an end attached to the rod and a second end located adjacent to the basket for manually actuating the rod.

In an embodiment of the invention, the transmission member includes a first gear mounted to the axle, a single-direction bearing mounted between the first gear and the axle such that the first gear is rotatable in only one direction, a second gear mounted to the output shaft of the hydraulic pump, and a chain mounted around the first gear and the second gear.

In an alternate embodiment of the invention, the transmission member includes a first pulley mounted to the axle, a single-direction bearing mounted between the first gear and the axle such that the first gear is rotatable in only one direction, a second pulley mounted to the output shaft of the hydraulic pump, and a belt mounted around the first pulley and the second pulley.

The rod includes a pulley mounted thereto, and the pull string is wound around the pulley, and an elastic member is attached to the rod for biasing the rod to a position in which the fluid path is normally closed such that the output shaft does not rotate.

The emergency escape device may further comprise a sprocket mounted to the axle to rotate therewith, and a chain may be wound around the sprocket for manual operation to lift the basket.

Other objects, advantages, and novel features of the invention will become more apparent from the following detailed description when taken in conjunction with the accompanying drawings.

DESCRIPTION OF THE PREFERRED EMBODIMENTS

Figure 1:
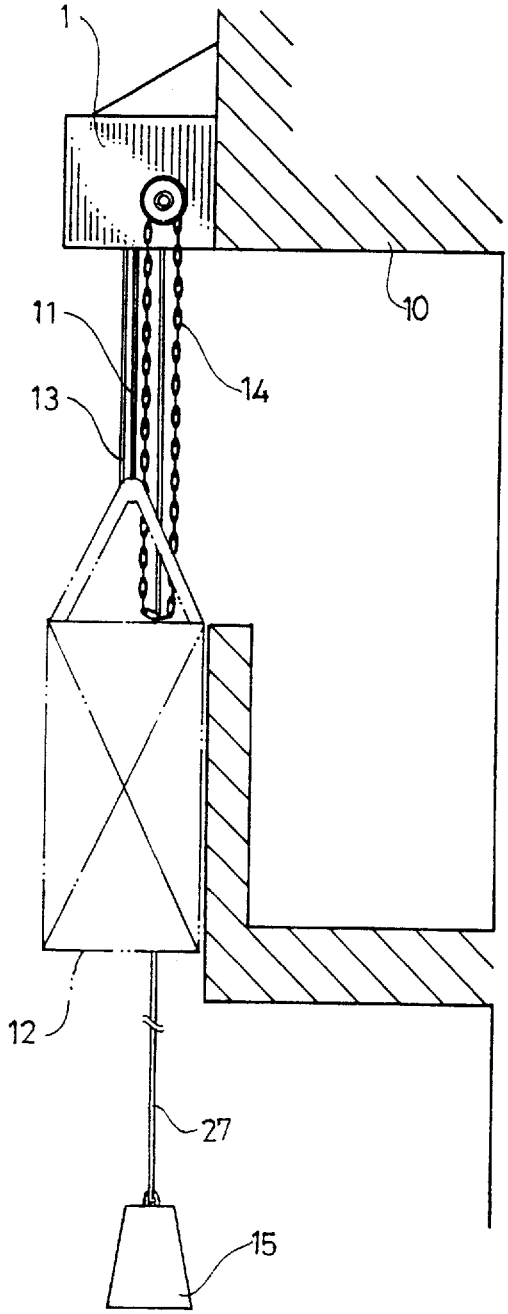
FIG. 1 is a schematic side view of an emergency escape device in accordance with the present invention mounted to a wall of a building.

Referring to the drawings and initially to FIG. 1, an emergency escape device in accordance with the present invention includes a housing 1 mounted to a wall 10 of a building and generally includes a life basket 12 lifted by a cable 11, and a pull string 13 is provided to control the lowering of the basket 12. In case of emergency, a person may enter the basket 12 and pull the pull string 13 to lower the basket 12 to the ground, and when the person leaves the basket 12, the basket 12 is lifted upwardly to its initially position by a weight means 15 having a weight greater than that of the basket 12 for another person to escape.

Figure 2:
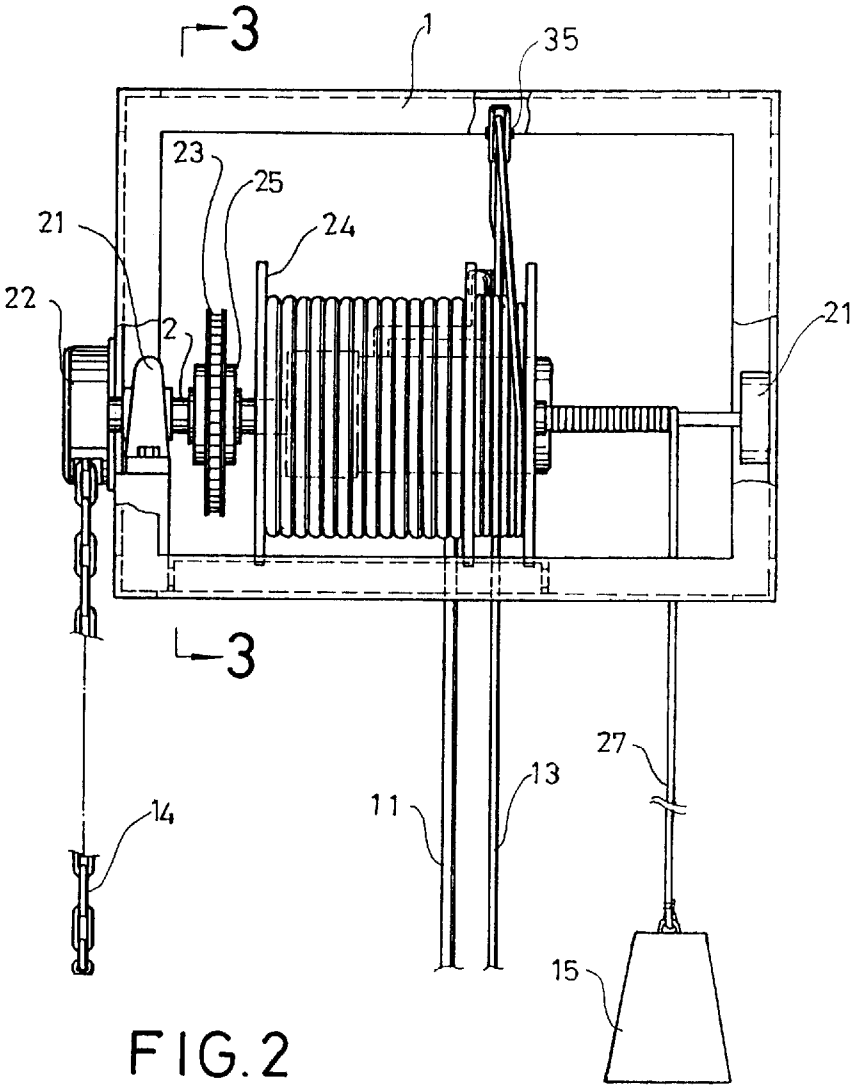
FIG. 2 is a front elevational view of an upper portion of the emergency escape device in accordance with the present invention.
Figure 3:
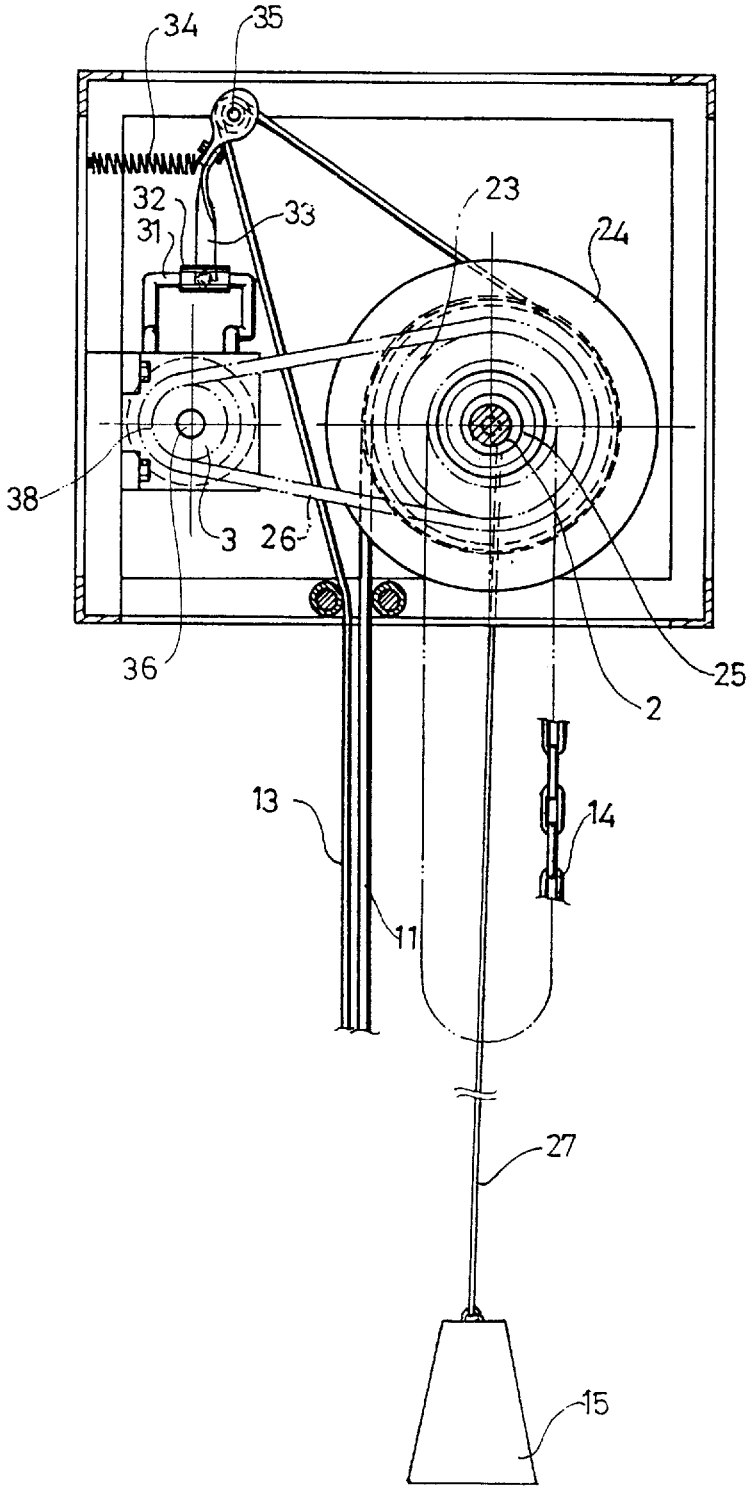
FIG. 3 is a side view taken along plane 3—3 in FIG. 2.

Referring to FIGS. 2 and 3, an axle 2 is rotatably mounted in the housing 1 and supported by a bearing means 21.

A reel 24 is mounted on the axle 2 to rotate therewith. The cable 11 is wound around the reel 24 and includes a free end to which the basket 12 is attached, whereby rotational movement of the reel 24 results in vertical movement of the basket 12. A string 27 is wound around the axle 12 and includes a first end securely attached to the axle 12 and a second end to which the weight means 15 is securely attached. The winding direction of the string 27 is opposite to that of the cable 11 such that when the string 27 is rolled, the cable 11 will be extended, and when the string 27 is extended, the cable 11 will be rolled. The weight means 15 has a weight greater than that of the basket 12 such that when a person has reached the ground and left the basket 12, the basket 12 will be lifted again for saving another person. The length of the string 27 is selected to prevent from being used by burglars.

A transmission member, e.g, a first gear 23 is mounted on the axle 2, and a single-direction bearing 25 is mounted between the axle 2 and the first gear 23 such that the first gear 23 may rotate in only one direction. The first gear 23 is driven by an output shaft 34 of a hydraulic pump 3 via a chain 26 and a second gear 38 mounted on the output shaft 34, as shown in FIG. 3. However, both of the first gear 23 and the second gear may be replaced by a pulley, and the chain 26 may be replaced by a belt.

Figure 4:
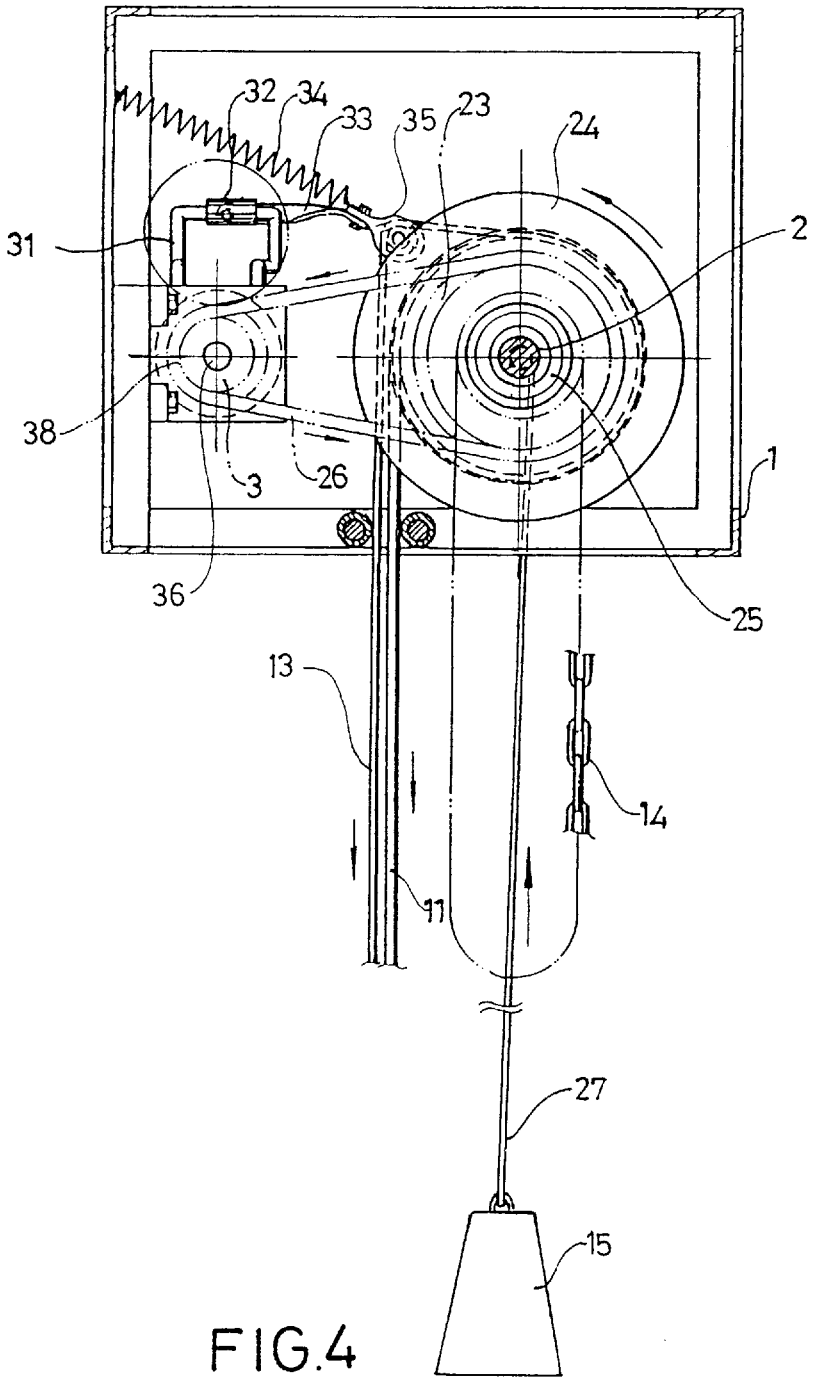
FIG. 4 is a view similar to FIG. 3, illustrating operation of the emergency escape device.
Figure 5:
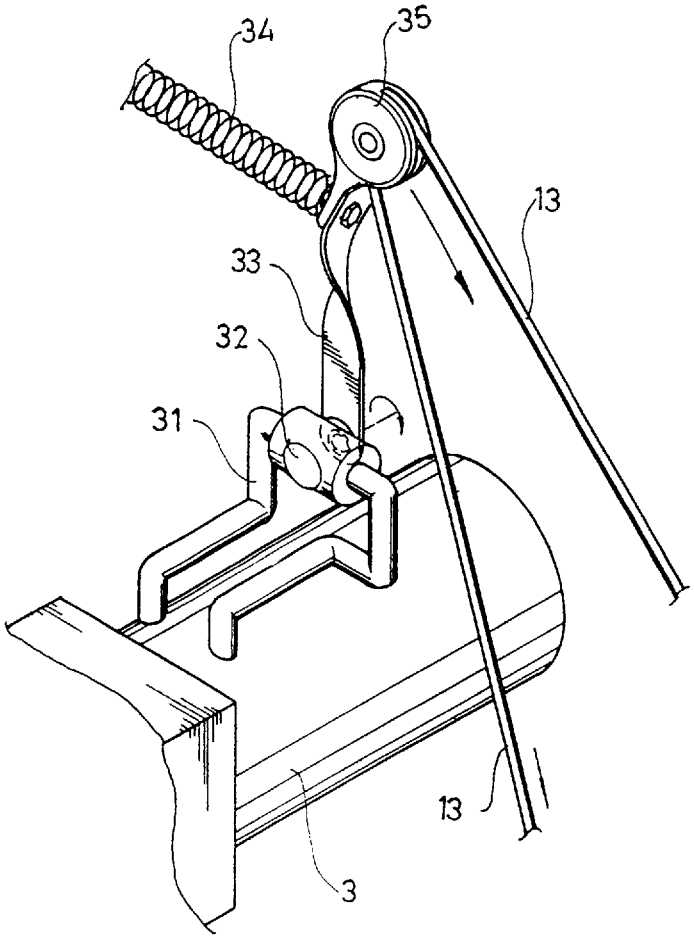
FIG. 5 is an enlarged exploded view of a circle in FIG. 4.
Figure 7:
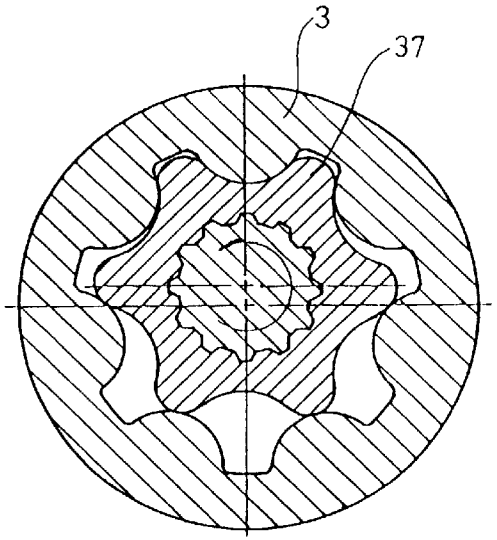
FIG. 7 is a sectional view taken along plane 7—7 in FIG. 6.
Figure 6:
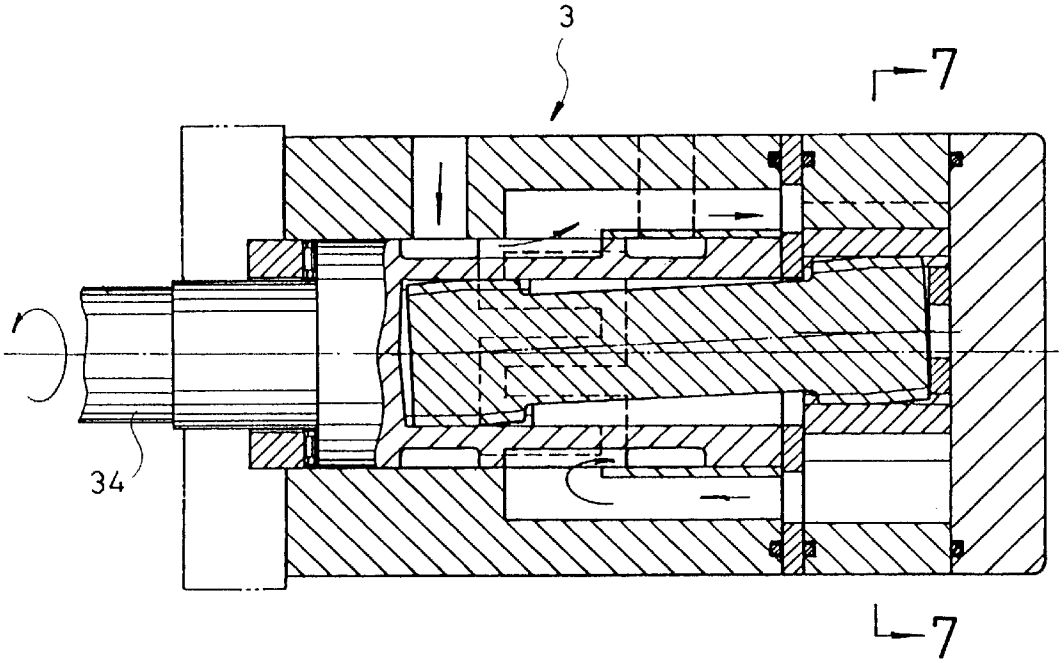
FIG. 6 is a sectional view of the motor.

Referring to FIGS. 3 and 5, a fluid path 31 is provided to the hydraulic pump 3, and a control valve 32 is mounted to the fluid path 31 and actuatable by a rod 33 which, in turn, is biased by an elastic member 34 such that the fluid path is normally closed. A pulley 35 is mounted to an end of the rod 33 and the pull string 13 is wound around the pulley 35 and has a first end wound around the axle 2 (see FIG. 2) and a second end located at a position operable by the person in the basket 12. When the person enters the basket 12 under emergency and pulls the pull string 13, as shown in FIG. 4, the rod 33 is moved downwardly to open the fluid path 31, such that a rotor 37 in the hydraulic pump 3 rotates and thus causes the output shaft 34 of the motor 3 to rotate. The basket 12 is accordingly lowered while the weighted means 15 is lifted. It is appreciated that the total weight of the basket 12 and the person is preferably greater than the weight of the weight means 15. When the pull string 13 is released, the rod 33 is returned under the action of the elastic member 34 such that the fluid path is closed again. Thus, output shaft 34 of the hydraulic pump 3 as well as the basket 12 stop. Again, when a person has reached the ground and left the basket 12, the basket 12 will be lifted again under the action of the weight means 15 for saving another person.

According to the above description, it is appreciated that the emergency escape device in accordance with the present invention can be operated under emergency without electricity, and the lowering speed of the basket can be controlled by the person inside the basket. In addition, the basket can be lifted again to save another person. A sprocket 22 may be mounted on an end of the axle 2 to rotate therewith, and a chain 14 may be wound around the sprocket 22, and the user may repetitiously pull the chain along a direction, e.g., clockwise, to lift the basket 12.

Although the invention has been explained in relation to its preferred embodiment, it is to be understood that many other possible modifications and variations can be made without departing from the spirit and scope of the invention as hereinafter claimed.

What is claimed is:

1. An emergency escape device for buildings, comprising:

a rotatably supported axle, a reel mounted on the shaft to rotate therewith, a string wound around the axle and having a first end securely attached to the axle and a second end, a weight means being securely attached to the second end of the string, a cable wound around the reel and having a free end, the cable having a winding direction opposite to that of the string, a basket securely attached to the free end of the cable and having a weight smaller than that of the weight means, a hydraulic pump including a fluid path and an output shaft, a control valve being mounted to the fluid path for controlling opening and closing of the fluid path to thereby control rotational movement of the output shaft, a transmission member for transmitting rotational movement of the output shaft to the axle, a rod mounted to the control valve for actuating the control valve, and a pull string having an end attached to the rod and a second end located adjacent to the basket for manually actuating the rod.

2. The emergency escape device according to claim 1, wherein the transmission member includes a first gear mounted to the axle, a single-direction bearing mounted between the first gear and the axle such that the first gear is rotatable in only one direction, a second gear mounted to the output shaft of the hydraulic pump, and a chain mounted around the first gear and the second gear.

3. The emergency escape device according to claim 1, wherein the transmission member includes a first pulley mounted to the axle, a single-direction bearing mounted between the first gear and the axle such that the first gear is rotatable in only one direction, a second pulley mounted to the output shaft of the hydraulic pump, and a belt mounted around the first pulley and the second pulley.

4. The emergency escape device according to claim 1, wherein the rod includes a pulley mounted thereto, and the pull string is wound around the pulley, and an elastic member is attached to the rod for biasing the rod to a position in which the fluid path is normally closed such that the output shaft does not rotate.

5. The emergency escape device according to claim 1, further comprising a sprocket mounted to the axle to rotate therewith, and a chain is wound around the sprocket for manual operation to lift the basket.

* * * * *